US008307500B2

(12) United States Patent
Gonzales et al.

(10) Patent No.: US 8,307,500 B2
(45) Date of Patent: Nov. 13, 2012

(54) CONVERTIBLE WHEELED LUGGAGE HANDLE

(75) Inventors: Bonnie Jean Gonzales, Rosemont, IL (US); Oscar Gonzales, Rosemont, IL (US)

(73) Assignee: Oscar Gonzales, Rosemont, IL (US)

( * ) Notice: Subject to any disclaimer, the term of this patent is extended or adjusted under 35 U.S.C. 154(b) by 415 days.

(21) Appl. No.: 12/661,138

(22) Filed: Mar. 10, 2010

(65) Prior Publication Data

US 2010/0275415 A1 Nov. 4, 2010

Related U.S. Application Data

(60) Provisional application No. 61/210,644, filed on Mar. 20, 2009.

(51) Int. Cl.
*A45C 13/22* (2006.01)

(52) U.S. Cl. ..... 16/113.1; 16/405; 16/408; 16/430; 190/115

(58) Field of Classification Search ..... 16/113.1, 16/114.1, 405, 406, 408, 409, 410, 411, 422, 16/426, 427, 429, 430, 110.1; 280/37, 655.1; 190/115, 117
See application file for complete search history.

(56) References Cited

U.S. PATENT DOCUMENTS 5,075,925 A * 12/1991 Maloney ..... 16/113.1
5,647,095 A * 7/1997 Takimoto ..... 16/405
5,996,175 A * 12/1999 Fusco ..... 16/114.1
6,024,376 A * 2/2000 Golichowski et al. ..... 280/655.1
6,065,574 A * 5/2000 Miyoshi ..... 190/115
6,464,245 B1 * 10/2002 Miles ..... 16/113.1
7,322,583 B2 * 1/2008 Kim et al. ..... 280/206
2003/0132080 A1 * 7/2003 Dababneh ..... 190/115
2004/0079603 A1 * 4/2004 Miller et al. ..... 190/115
2004/0124054 A1 * 7/2004 Lu ..... 190/115
2004/0154131 A1 * 8/2004 Earley et al. ..... 16/406
2004/0238304 A1 * 12/2004 Fisher ..... 190/115
2005/0016809 A1 * 1/2005 Wu ..... 190/115
2005/0071951 A1 * 4/2005 Joesten ..... 16/114.1
2005/0087415 A1 * 4/2005 Gorga et al. ..... 190/115
2005/0279600 A1 * 12/2005 Goldwitz ..... 190/115

* cited by examiner

*Primary Examiner* — Jeffrey O Brien

(57) ABSTRACT

A convertible wheeled luggage handle comprises a housing holding a movable swivel handle, and the swivel handle is locked from moving outside the housing by a spring-loaded detent pin engaging a hole, and this detent pin can be raised from the hole freeing the swivel handle to pivot outside the housing by a retainer pin driven through the width of the swivel handle at the housing, and each end of this retainer pin protrudes slightly from each side of the swivel handle, and these protruding ends correspondingly sit into two accommodating slide members located along opposite lengths of the walls locking the swivel handle to the housing, besides locking and being the pivot point for the swivel handle these protruding pin-ends from the retainer pin have the additional function of sliding the swivel handle along the slide members in order to position the swivel handle outside/perpendicular to the housing.

2 Claims, 8 Drawing Sheets

Fig. 1 Swivel handle 22 extended out from main handle housing 10

Fig. 1A swivel handle 22 dropping down into handle housing 10

Fig. 1B swivel handle 22 lying inside handle housing 10.

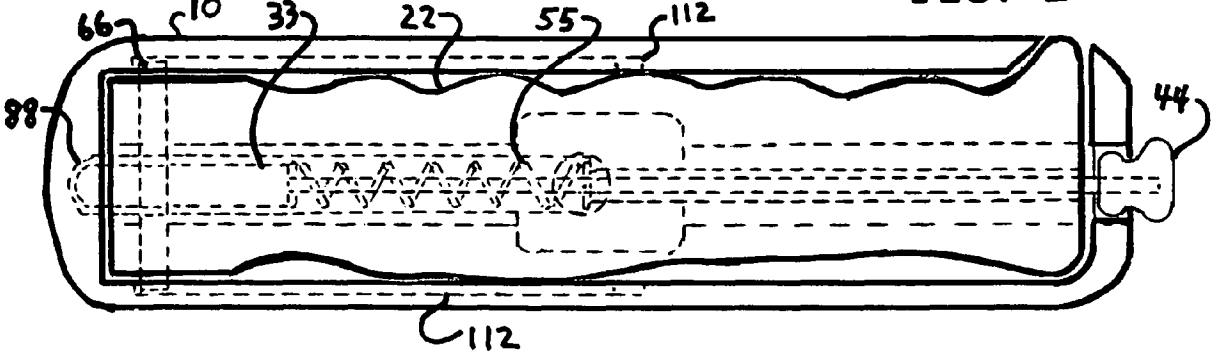

FIG. 2

Fig. 2: Top view; swivel *handle* 22, swiveled totally down and lies inside the *main handle housing* 10. Interior view of *swivel handle* 22, includes; *detent pin*33, normally extended *compression spring* 55, *retainer pin* 66 and *end-cap* 44. And the end of the *detent pin* 33locked into the end *retaining hole* 88.

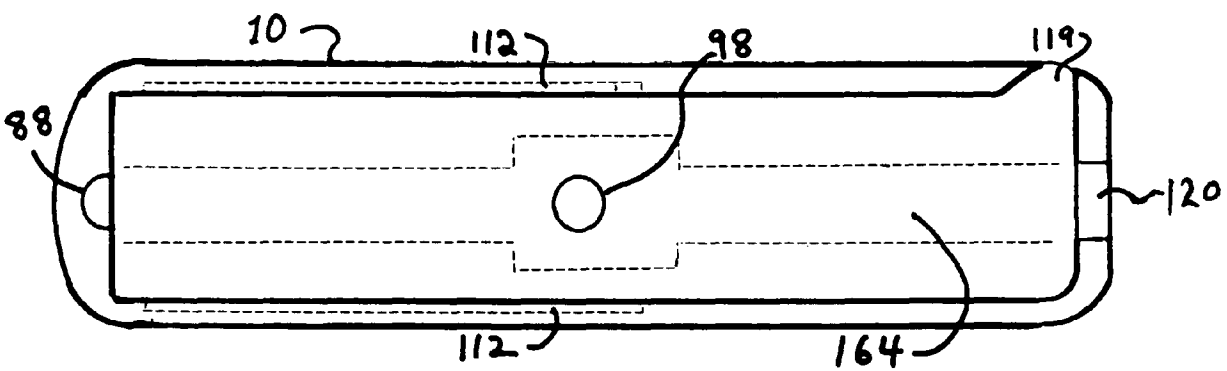

FIG. 2A

Fig. 2A: Top view of *main handle housing* 10 and its composition as shown in Fig. 2 sans the *swivel handle* 22 and it's components.

Fig. 3: Side cross section view, of *main handle housing* 10 and its composition.

Fig. 3A Side view of *upright release button* 77 to insert into *compartment* 164

Fig. 4 Cross section of *swivel handle* 22. The *detent pin* 33 lifted up by means of the *end-cap* 44.
Fig. 4A Cross section of *swivel handle* 22. The *detent pin* 33 protrudes out from the end of the *swivel handle* 22.
Fig. 4B A different view of *swivel handle* 22. As in Fig. 4 the *detent pin* 33 is lifted by means of the *end-cap* 44.

Fig. 5 Exploded view of the *swivel handle* 22 and the components:

- *End-Cap* 44
- *Compression spring* 55
- *Detent pin* 33
- *Handle retainer pin* 66

FIG. 6

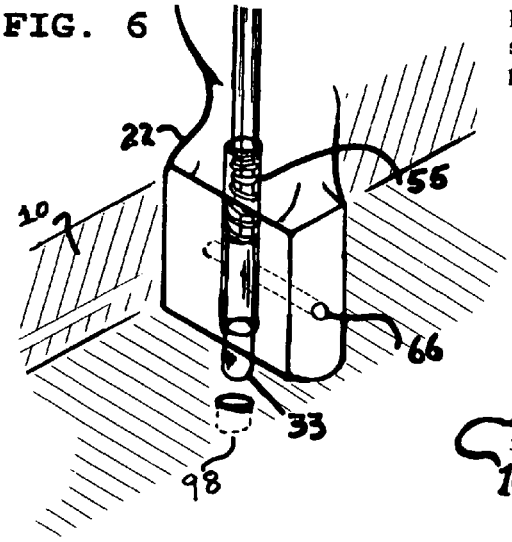

Fig. 6 Cross section of the end of swivel *handle* 22 set inside *handle housing* 10. The *detent pin* 33 under pressure from *compression spring* 55 begins to seat into *center retaining hole* 98.

Fig. 6A A closer view of *detent pin* 33 ready to seat into *center retaining hole* 98 located in *main handle housing* 10.

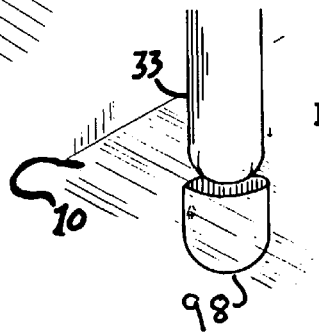

FIG. 6A

FIG. 7

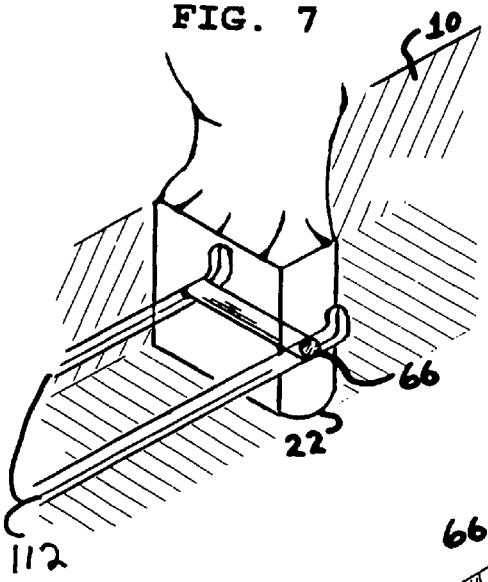

Fig. 7 Cross section, the end of the *swivel handle* 22 inside *main handle housing* 10 with the *handle retainer pin* 66 riding on two *slide members* 112.

Fig. 7A A closer view of the *retainer pin* 66 without the view of the *swivel handle* 22, sets inside a *slide member* 112.

FIG. 7A

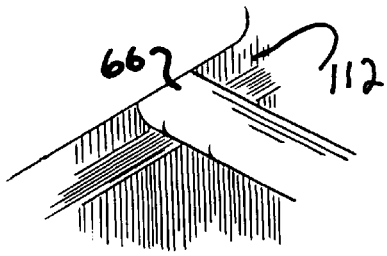

FIG. 8

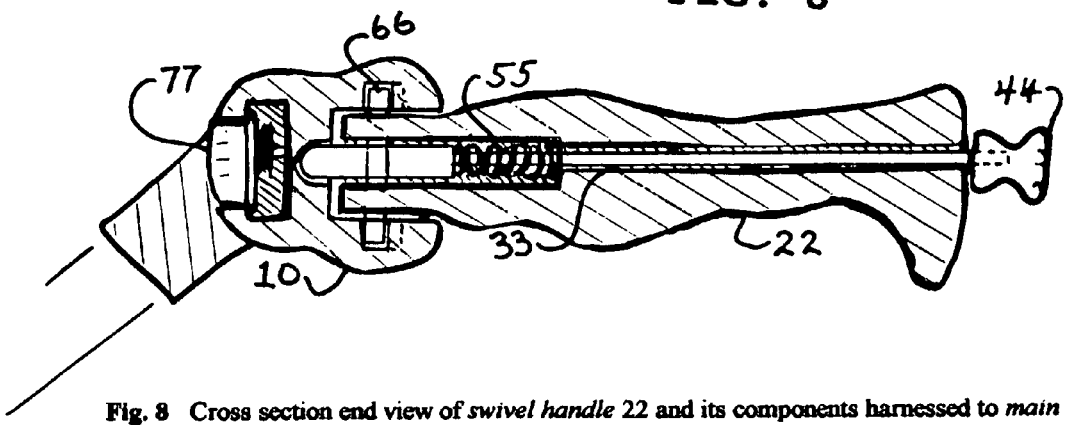

Fig. 8 Cross section end view of *swivel handle* 22 and its components harnessed to *main handle housing* 10 by the *retainer pin* 66, shows the essence of the totality *of* the wheeled luggage handle with the *swivel handle* 22 extended outside the *main housing* 10.

FIG. 8A

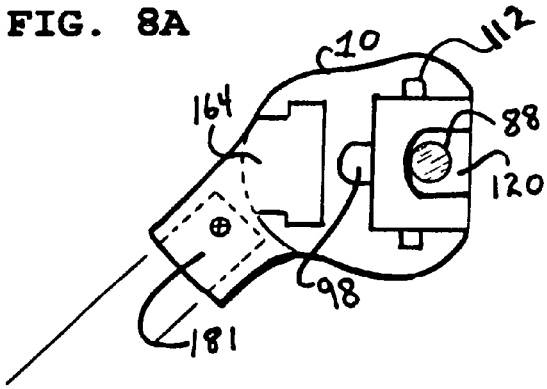

Fig. 8A End cross section view of *main handle housing* 10 and its composition sans *swivel handle 22 and its components and sans release button 77.*

FIG. 8B

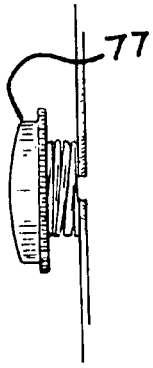

Fig. 8B *Release button 77* that sits inside *space* 164 of *main handle housing* 10.

Fig. 9 Side sole view of *swivel handle* 22 and its composition sans its components.

Fig. 10 Cross section of the end of the *swivel handle*22 set inside the *main handle housing 10*. The *detent pin* 33 set inside the *center retaining hole* 98. the *retaining pin* 66 set into the "L" shaped *slide member* 112.

CONVERTIBLE WHEELED LUGGAGE HANDLE

This application claims priority to the provisional application No. 61/210,644 filed on Mar. 20, 2009.

BACKGROUND OF THE INVENTION

1. Field of the Invention

The present invention relates to an ergonomic handle, unlike traditional handles currently used on many wheeled luggages or carts, and particularly the present invention is a more user friendly method of pulling these wheeled apparatuses.

2. Description of Prior Art

Since the invention of traditional wheeled luggages or carts, people have been inclined to pull many of these apparatuses by means of a traditional and commonly used parallel-to-the-luggage handle that is not normally user friendly.

For Example:

Most of these prior handle designs put the users hand in an abnormal position for pulling, these wheeled luggages or carts. This twisted hand and wrist position used for grasping this prior handle design, usually at a 90 degrees angle to the body—the hand twisted either to the extreme right with the thumb pointed away from the body and the fingers around the handle folded forward, or to the extreme left with the thumb pointed toward the body and the fingers around the handle folded toward the back. Again, these unnatural hand positions needed to pull these wheeled luggages or carts not only puts undue stress on the wrist, but also strains the lower and upper arm and shoulder as evidenced by the users constant alternation of their hand grip. These abnormal hand and arm positions can also negatively effect the users neck and related muscles which may cause side pain, back pain, headaches, and other aches and pains in the persons body caused by this unnecessary stress.

The present invention has arisen to mitigate the afore-described problems.

SUMMARY OF THE INVENTION

The primary objective of the present invention is to provide a user friendly ergonomic handle that can easily be converted from the common parallel-to-the-luggage-handle-design to a handle that is put at a more positive perpendicular angle to this wheeled luggage handle by simply lifting and locking a swivel handle housed within a similar to the conventional parallel-to-the-luggage handle. This new swivel-out-of-the-housing handle is designed primarily to put the users hand in a more normal position for pulling these wheeled apparatuses, hence tremendously reducing undue stress on the users wrist, lower and upper arm, side, shoulder, neck and other related muscles. The swivel handle can then be released and dropped back inside its own housing for easy storage.

The secondary objective of the present invention is to provide an ergonomic handle design that can easily be adapted to most manufacturing of wheeled luggages or carts who use the common retractable up-rights* on their designs. This can be done without too much change in the overall design or concept of these existing apparatuses.

DESCRIPTION OF THE DRAWINGS

FIG. 2 of the invention is the swivel handle 22 set inside the handle housing 10 and indicating the interior position of the detent pin 33 in relation to the compression spring 55 and the retainer pin 66 and the end-cap 44 fitted at the end of the detent pin 33. Two holes 88 and 98 in the housing 10 used to hold the handle 22 in position via the detent pin 33 either while the handle 22 is "inside" the housing 10, or while the handle 22 is "outside" the housing 10. Visible is the shaft 139 where the detent pin 33 is inserted inside the swivel handle 22. Vacant area 164 at the bottom of the housing 10 where the release button 77 and existing manufacturers (not shown) mechanisms which are ordinarily used to release the conventional uprights of the traditional wheeled luggage down into the luggage-body are to be housed. Two L shaped slide members 112 in the handle housing 10 are where the two protruding ends of the retainer pin 66 are to slide while swiveling the handle 22 into position and eventually locking said swivel handle 22 into place.

FIG. 2A of the invention is the embodiment of handle housing 10 sans the swivel handle 22. Two accommodating retainer holes; the end retainer hole 88 located at the end of the handle housing 10 and the center retainer hole 98 located at the bottom center of the handle housing 10. Beneath the housing 10 is a vacant area 164 used to house the release button 77 and existing manufacturers (not shown) mechanisms. On the two opposite housing 10 walls are the two L shaped slide members 112 used for the protruding ends of the retainer pin 66 to slide-on while swiveling, positioning and locking the swivel handle 22. The lip-notch 119 is for the lip of the swivel handle 22. Cap notch 120 is to accommodate the end-cap 44.

FIG. 6 of the invention is a cross section view of swivel handle 22 and detent pin 33 interacting with the center retainer hole 98 at the bottom of the handle housing 10.

FIG. 6A of the invention is a clearer understanding of the interaction of the detent pin 33 and the center retainer hole 98.

FIG. 7 of the invention is the retainer pin 66 set through the pin shaft 208 located at 'U' shaped end of the swivel handle 22 and the two protruding ends of the retainer pin 66 ride on the two accommodating L shaped slide members 112 located on both long-sides of the walls of the handle housing 10.

FIG. 7A of the invention a view taken from FIG. 7, is a clearer understanding of one of the two protruding ends of the retainer pin 66 riding on one of the two L shaped slide members 112 located on the inside walls of the handle housing 10.

FIG. 8 of the invention is an end cross section view of the handle housing 10 with the swivel handle 22 in place and extended outside the handle housing 10. The shaft 139 runs length-wise through the swivel handle 22 and shaft 139 houses the detent pin 33 which is under constant pressure from the compression spring 55. At one end of swivel handle 22 is the retainer pin 66 with its two protruding ends set into the two L shaped slide members 112. One end of the detent pin 33 set into the center retainer hole 98 located off center of the handle housing 10. At the large lip end of the swivel handle 22, the end-cap 44 is attached to the end of the detent pin 33 by any of several means. Area 164 is to house the release button 77 and existing manufacturers mechanisms (not shown) One of two extensions with holes 181, extend from the handle housing 10 where existing manufacturers luggage up-rights* are to be inserted and attached by any of several existing methods.

FIG. 8A of the invention is a cross section end-view of the handle housing 10. At one end of the handle housing 10 is the 'U' shaped cap notch 120 needed to accommodate the end-cap 44 when the swivel handle 22 is swiveled and collapsed down (laying) inside the handle housing 10. At the opposite end of the handle housing 10 is the end retainer hole 88 used by the detent pin 33 to hold the swivel handle 22 in place when the swivel handle 22 is lowered (laying) inside the handle housing 10. The vacant area 164 is used to house the release button 77 and existing manufacturers mechanisms (not shown). The bottom center retainer hole 98 is used to hold the swivel handle 22 in place by means of the detent pin 33 when the swivel handle 22 is outside (perpendicular) to the handle housing 10. One of two extensions extend from the handle housing 10 with hole 181 where existing luggage up-rights* are to be inserted and attached by any of several existing methods.

FIG. 8B of the invention is the release button 77. This button is used to release the existing manufacturers up-rights* by any of several current existing means.

DETAILED DESCRIPTION OF THE PREFERRED EMBODIMENTS

Figure 1:
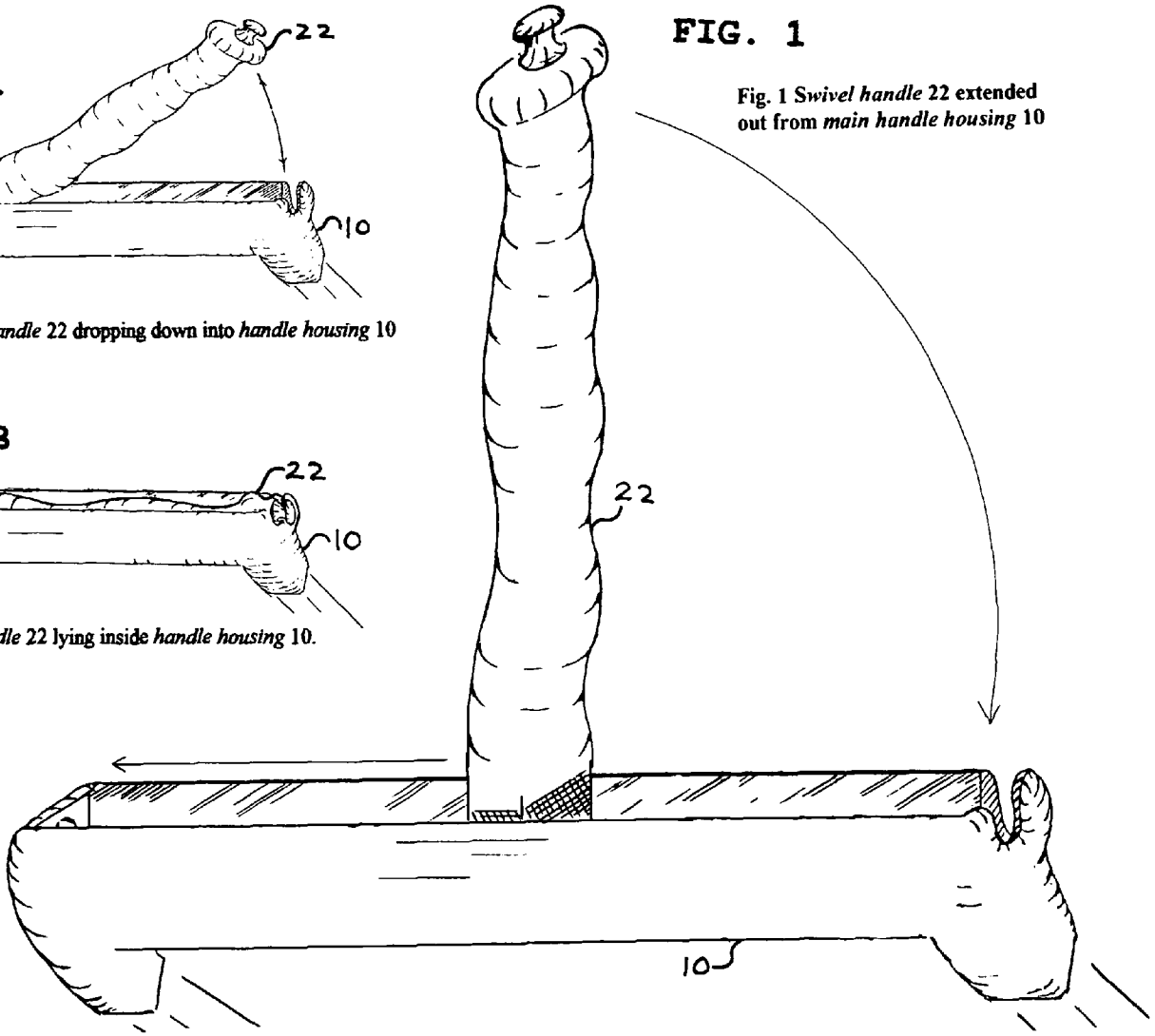
FIG. 1 of the invention is the orthoganol embodiment of the present invention with the swivel handle 22 extended perpendicular outside the handle housing 10 with the indicated direction and movement needed to collapse the swivel handle 22 inside the handle housing 10.
Figure 1A:
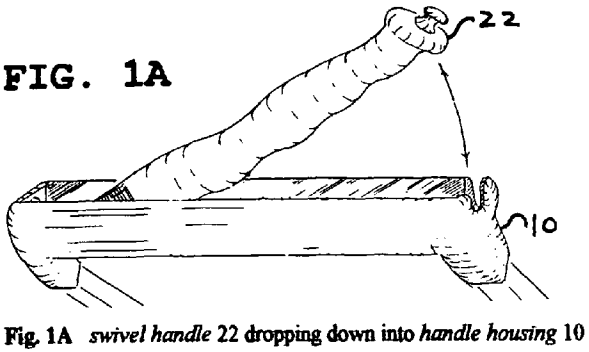
FIG. 1A of the invention shows a random position action of the swivel handle 22 dropping down towards the handle housing 10.
Figure 1B:
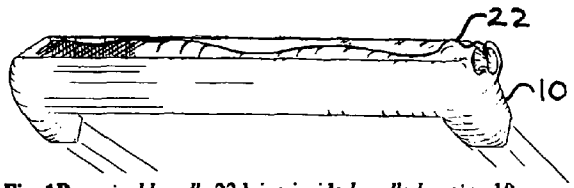
FIG. 1B of the invention shows the swivel handle 22 seated inside the handle housing 10.
Figures 3, 3A:
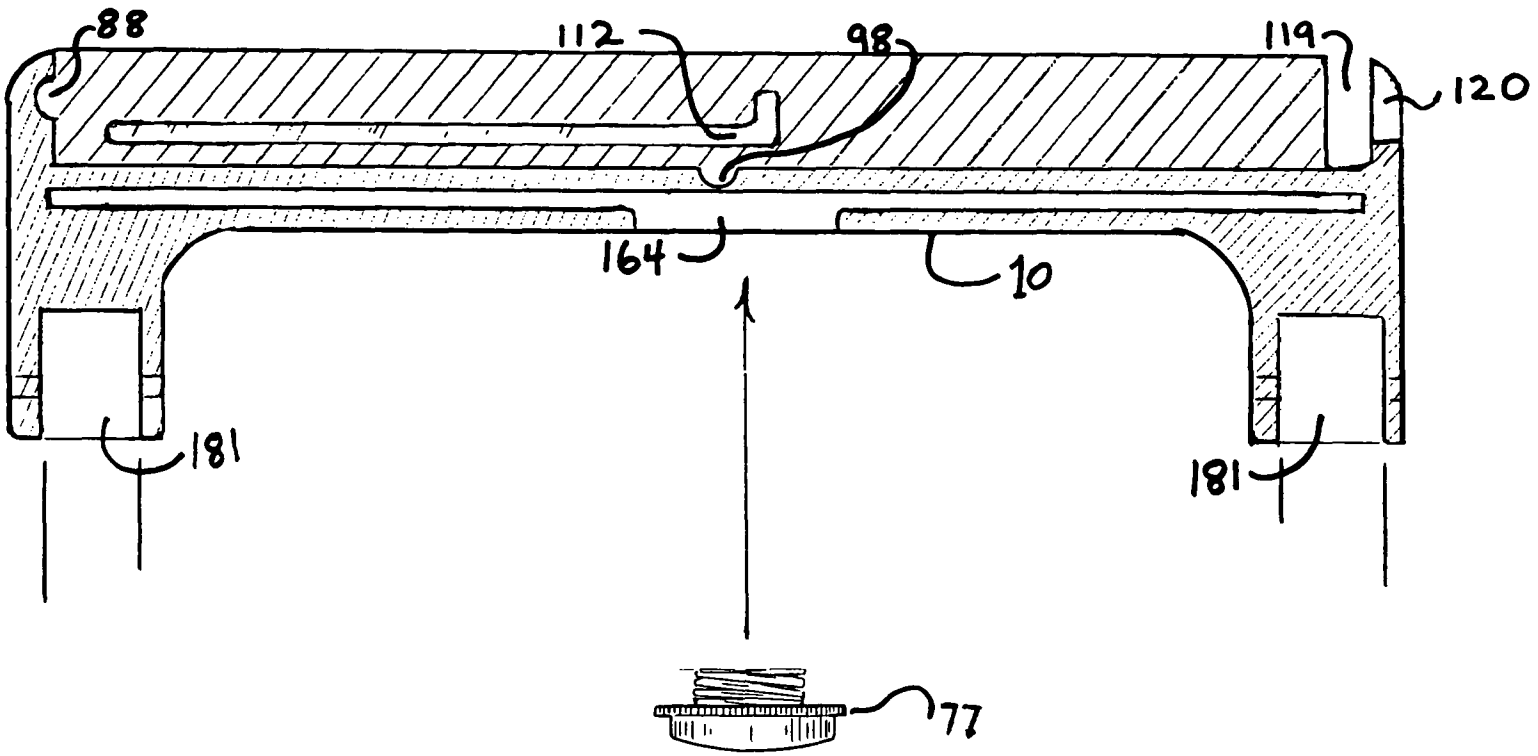
FIG. 3 of the invention is a cross section of the embodiment of handle housing 10. Visible is the retaining hole 88 located at the end of the housing 10 captures the detent pin 33 when the swivel handle 22 is down (laying) inside the housing 10 and retaining hole 98 located in the center-bottom of the housing 10, while the swivel handle 22 is extended outside (perpendicular) to the housing 10. One of the two L shaped slide members 112 visible on the housing 10 wall, runs from off-center to the proximity of the left end of the housing 10. Beneath housing 10 is the vacant area 164 used to house the release button 77 and other existing manufacturers mechanisms. Cap notch 120 accommodates the end-cap 44 and the lip-notch 119 accommodates the large lip end of the swivel handle 22 while it's laying in the housing. Holes 181 (2) accommodate the manufacturers existing luggage up-rights*.
FIG. 3A of the invention is the release button 77 used to release the existing manufacturers mechanisms by any means and cause the existing manufacturers luggage up-rights* (up-rights that can be attached to the handle housing 10 at the two accommodating holes 181, FIG. 3) to be released, and thus being released will allow the existing manufacturers up-rights* and the totality of the invention: convertible wheeled luggage handle, to be collapsed down inside the existing housing of the manufacturers wheeled luggage or apparatus.

Referring to FIGS. 1, 1A and 1B, a convertible handle in accordance with the present invention and comprises a handle housing 10, an end-cap 44. a swivel handle 22 in a variant stage of movement into the handle housing 10.

The swivel handle 22 comprises an overall contoured design suitable for hand gripping with a large lip at one end of the swivel handle 22 to prevent hand grip slippage. The other end of the swivel handle 22 is rounded on one side with three flat sides. A shaft 139 runs length-wise through the swivel handle 22 in two-step graduates. The first step consists of a narrow shaft starting from the lip-end of the swivel handle 22 and goes approximately two-thirds of the way through the swivel handle 22. The second step of the same shaft 139 is wider and goes the other third and exiting at the handle housing 10 end of the swivel handle 22.

Figure 4:
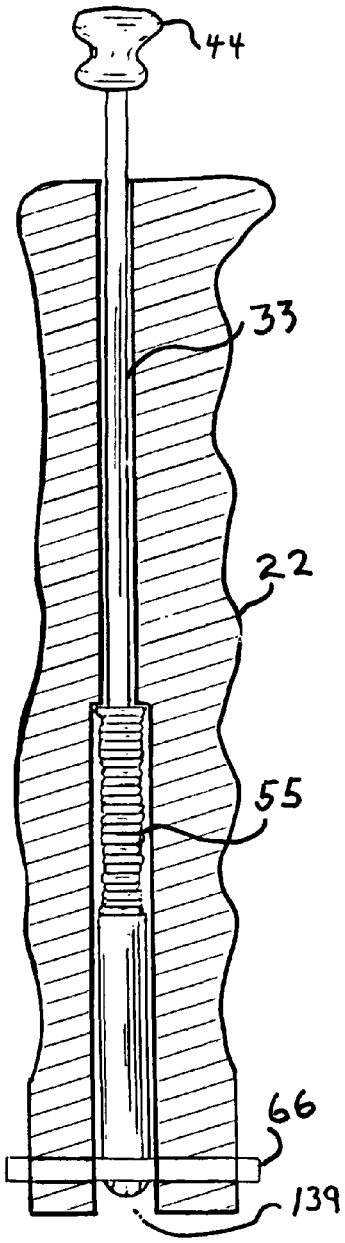
FIG. 4 of the invention is a cross section of the swivel handle 22 showing the detent pin 33 retracted inside the contoured shaft 139 by means of the end cap 44, and the compression spring 55 compressed from its normally expanded position inside the contoured shaft 139. This retracted detent pin 33 position releases the swivel handle 22 to be either swiveled perpendicular (outside) the handle housing 10 or "lowered" down (inside) the handle housing 10. At one end of the handle 22 is the retainer pin 66 with the two ends of the pin protruding outside each side of the handle 22.
Figure 4A:
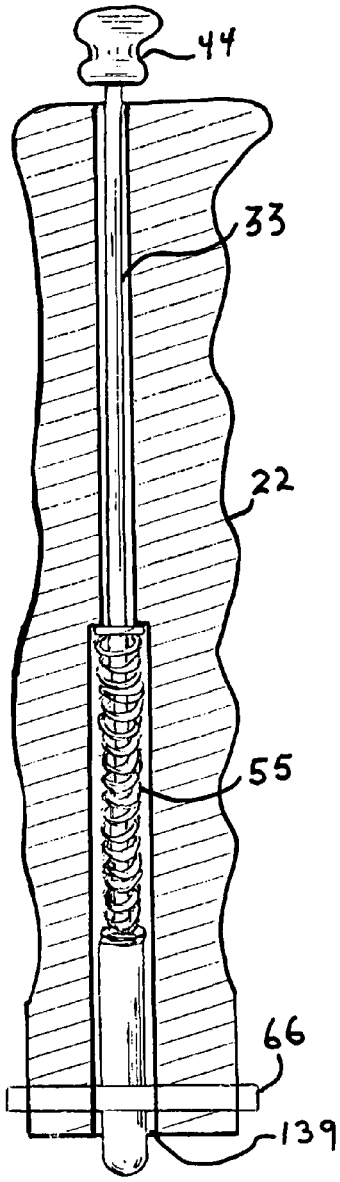
FIG. 4A of the invention is the same cross section view as FIG. 4 only with the detent pin 33 protruding outside the end of contoured shaft 139 of the swivel handle 22, and the compression spring 55 normally expanded in the interior of the contoured shaft 139. This outside the end of the swivel handle 22 position of the detent pin 33, locks the swivel handle 22 either outside (perpendicular) to the handle housing 10, or down (laying) inside the housing 10, by inserting the end of the detent pin 33 which is in constant pressure from the compression spring 55 into either of two retainer holes, the end retainer hole 88 (FIG. 3), located at the end of the handle housing 10, for locking the swivel handle 22 in place when the swivel handle 22 is closed (laying down) inside the handle housing 10, and/or the other center retainer hole 98 (FIG. 3), located at the bottom of main housing 10 is for locking the swivel handle 22 in place when the swivel handle 22 is in the open (perpendicular) to the handle housing 10 position.
Figure 4B:
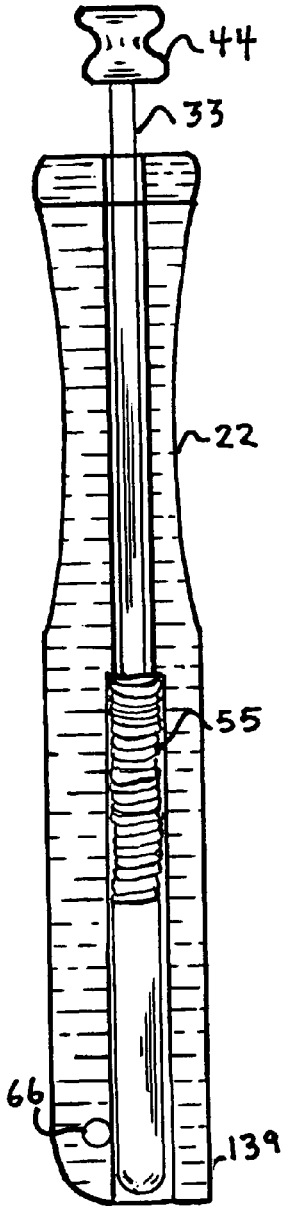
FIG. 4B of the invention is a 90 degree cross sectional view of FIG. 4. the shaft 139 and detent pin 33 slightly off center of the handle 22.

The graduated shaft 139 in the swivel handle 22 is purposely made off-center as in FIG. 4B in order to accommodate the pin shaft 208 made at a right angle to the shaft 139 at the handle housing 10 end of the swivel handle 22 and the pin shaft 208 will house the retainer pin 66. The shaft 139 in the swivel handle 22 houses the detent pin 33 and the compression spring 55, and the shaft 139 has diameter clearance enough to allow free slide movement of the detent pin 33 and to allow the compression spring 55 unhindered movement in order to apply constant pressure to the detent pin 33 by means of one end of the compression spring 55 using leverage against the lip formed at the wider end of the shaft 139 and the other end of the compression spring 55 puts pressure against the larger end of the detent pin 33.

The handle housing 10 end of the swivel handle 22 having a pin shaft 208 going through the opposite flat sides of the swivel handle 22 and running at a right angle to the shaft 139 and the pin shaft 208 is housing to the retainer pin 66 and the retainer pin 66 is contacting the wider end of the detent pin 33 inside the swivel handle 22 and the retainer pin 66 being longer than the width of the swivel handle 22 leaves the ends of the retainer pin 66 to protrude out of both sides of the swivel handle 22.

The shaft 139 running off-center length-wise through the swivel handle 22 comprises a single two-step shaft, the smaller diameter of the shaft being the longer and the larger diameter of the shaft being shorter. The shorter and wider end of the shaft 139 being and exiting at the handle housing 10 end of the swivel handle 22 and the smaller diameter end of the shaft being and exiting at the lip end of the swivel handle 22 and the detent pin 33 along with the normally expanded compression spring 55 is inserted into the shaft 139, found in the swivel handle 22. And thus inserted, the end-cap 44 is connected by any of several conventional means to the smaller diameter end of the detent pin 33 located protruding out at the lip-end of the swivel handle 22 and the end-cap 44 prevents the detent pin 33 from springing out of the shaft 139 located in the swivel handle 22. The detent pin 33 thus being trapped inside the swivel handle 22 by the end-cap 44 will have the larger rounded end of the detent pin 33 protruding out of the handle housing 10 end of the swivel handle 22 by approximately 5/16 to 3/8 of an inch.

By grasping and pulling up on the end-cap 44 and the detent pin 33 compressing the normally expanded compression spring 55 will draw the larger protruding end of the detent pin 33 inside the shaft 139 located in the swivel handle 22.

Upon releasing the end-cap 44 and because the detent pin 33 is under constant pressure from the normally expanded compression spring 55, the detent pin 33 will return again to its normal protruding position which is more or less 5/16 to 3/8 inch outside the handle housing 10 end of the swivel handle 22.

Figure 5:
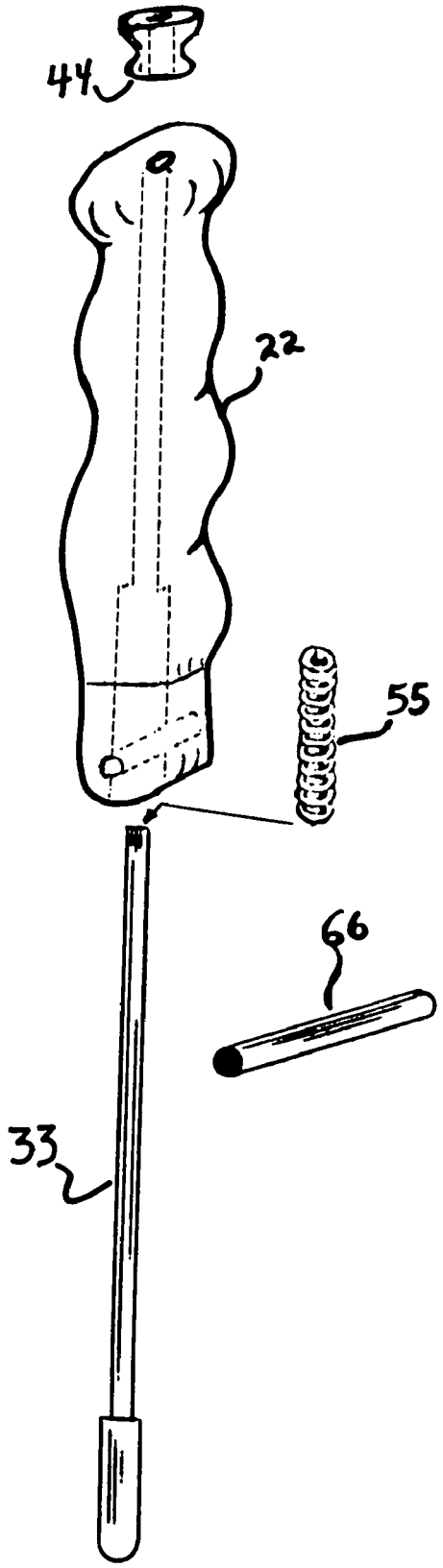
FIG. 5 of the invention is an exploded constitual view of the swivel handle 22, the detent pin 33, the end-cap 44, the compression spring 55, and the retainer pin 66.
Figure 9:
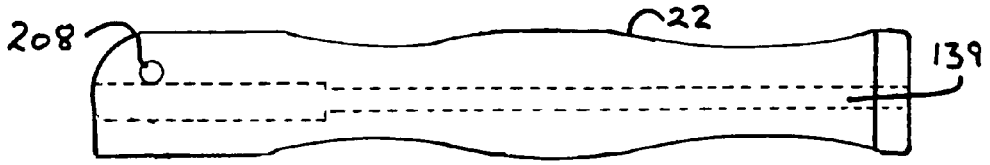
FIG. 9 of the invention is a side cross cut of the swivel handle 22 sans its associated components, showing the pin shaft 208 and the shaft 139.
Figure 10:
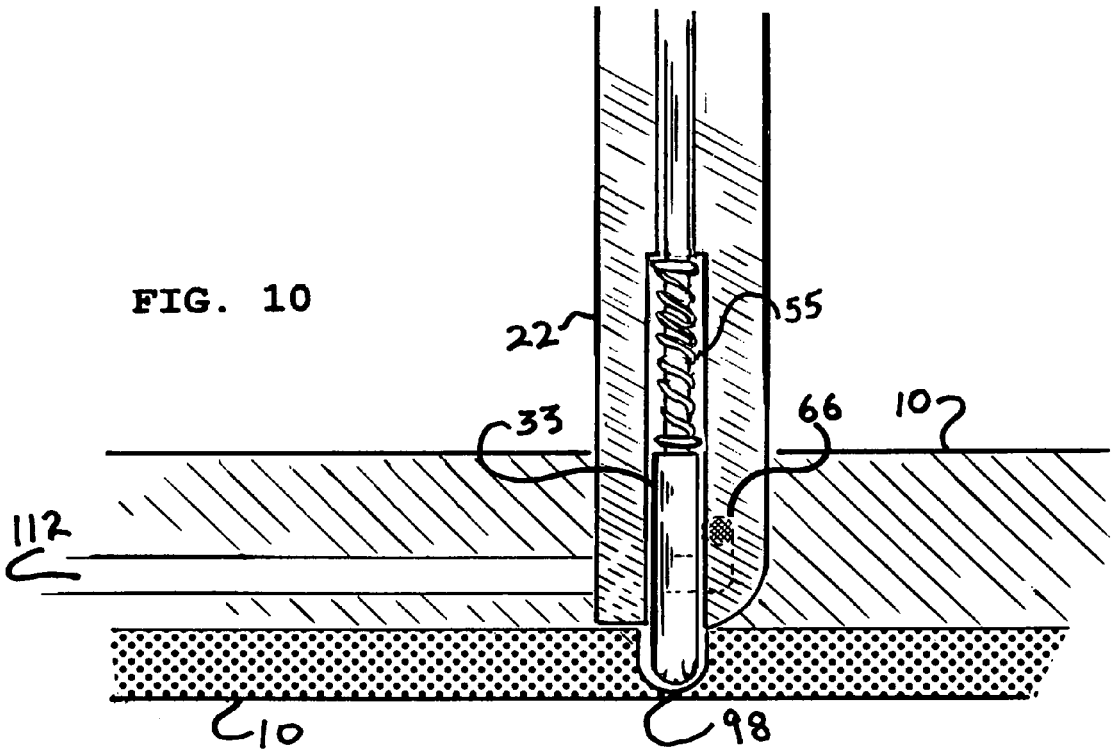
FIG. 10 of the invention is a side view of the end of the swivel handle 22 inserted into the handle housing 10. The compression spring 55 ordinarily expanded puts pressure on the detent pin 33 forcing the end of the detent pin 33 into the center retainer hole 98 located at the bottom of the housing 10. The detent pin 33 under pressure from the compression spring 55, forces and pushes the entire swivel handle 22 away from the handle housing 10 and with that action forces the protruding end of the retainer pin 66 to seat up into the small end of the L shaped slide member 112. And the detent pin 33 being firmly seated into the center retainer hole 98 located on the bottom of the handle housing 10 and the protruding end of the retainer pin 66 being thus seated in the small part of the L shaped slide member 112, in this configuration the swivel handle 22 is locked in the open (perpendicular) position outside the handle housing 10.

The handle housing 10' comprises a hollow housing contoured to accommodate the entirely assembled components FIG. 5 of the swivel handle 22. And the handle housing 10 has a floor, and the floor is also to divide a compartment 164 located at the bottom of the housing 10. This compartment 164 will accommodate the release button 77 needed to activate the existing manufacturers collapsing mechanism of choice normally used on their existing luggage handle up-rights*.

At one end-wall of the handle housing 10 is the end retainer hole 88 for the insertion (more or less) of 1/4 to 5/16 of an inch of the round end of the detent pin 33 protruding from the handle housing 10 end of the swivel handle 22 when the swivel handle 22 is dropped down (laying) inside the handle housing 10.

Slightly off center, on the floor of the handle housing 10, is the center retainer hole 98 needed for the round end of the detent pin 33 protruding from the handle housing 10 end of the swivel handle 22 to insert (approximately 1/4 to 5/16 of an inch) when the swivel handle 22 is open outside (perpendicular) to the handle housing 10.

Along the two opposite long-walls of the handle housing 10 are two long L shaped slide members 112 running parallel inside the handle housing 10. After the swivel handle 22 and its components are entirely assembled and joined with the accommodating handle housing 10 the two protruding ends of the retainer pin 66 located at the handle housing 10 end of the swivel handle 22 should be seated and respectively riding in each one of the two slide members 112.

And with the decision to open the swivel handle 22 to its perpendicular position outside the handle housing 10 each of the two protruding ends of the retainer pin 66 will slide along the two slide-members 112. And when the swivel handle 22 is fully open (perpendicular) to the handle housing 10 the two protruding ends of the retainer pin 66 will respectively be forced up into the two short vertical grooves of the L shaped slide members 112 by means of the compression spring 55 inside the shaft 139 putting constant pressure on the detent pin 33, and the protruding end of the detent pin 33 that extends outside the handle housing 10 end of the swivel handle 22 puts counter pressure against the center retainer hole 98 located on the floor of the handle housing 10, and the two protruding ends of the retainer pin 66 having thus been seated in the short ends of the two L shaped slide-members 112 and the protruding end of the detent pin 33 forced by the compression spring 55 being inserted into the center retainer hole 98 located on the floor of the handle housing 10 will naturally lock and hold firm the swivel handle 22 in the open (perpendicular) position.

Compartment 164 is located at the bottom of the handle housing 10 and is a vacant area separated by a dividing floor from the area that will house the swivel handle 22. Compartment 164 is contoured to house the release button 77 and existing manufacturers mechanisms and comprises the bottom length of the handle housing 10. And this vacant area 164 exits into, and is a part of two holes 181 inside the extensions located at either end of the handle housing 10. The holes 181 can be used to fasten the present invention to existing luggages or cart up-rights* using several commonly used methods. The compartment 164 may also be used to house the manufacturers existing up-right* release mechanisms of choice.

One end of the handle housing 10 has a cap notch 120 there to accommodate the end-cap 44 when the swivel handle 22 is closed (laying) down inside the handle housing 10. A lip-notch 119 located at the same end of the handle housing 10 accommodates the end lip contour of the swivel handle 22 when the swivel handle 22 is closed (laying) inside the handle housing 10.

Two extensions both a part of the handle housing 10 located at each end on the handle, housing 10 and the holes 181 located inside these extensions are used to attach manufacturers existing luggage up-rights* to the present invention by any of several means—these two handle housing 10 extensions should be at approximately 50 to 60 degrees angle to the horizontal plane of the handle housing 10 in order to maintain a parallel to the floor, perpendicular, swivel handle 22 while pulling the wheeled apparatus and maintaining the ergonomic position of the users hand. Different angles on the handle housing 10 extensions may be desired for different users and different uses of the current invention. Although the present invention is presented as a wheeled luggage and cart handle, the present invention can easily be applied to many situations not referred to in the application of the present invention and any such use or application still applies to the claim.

*The term "up-rights" references the two existing manufacturers poles or rails that attach to a luggage handle and used to tote a wheeled apparatus. These "up-rights" traditionally are collapsed along with the handle down inside the luggage for easier storage and are only referenced for clarity and are not part of the present invention.

| PARTS AND ITEMS LIST | |
|---|---|
| PART NO. | DESCRIPTION |
| 10 | Handle housing |
| 22 | Swivel Handle |
| 33 | Detent Pin |
| 44 | End-cap |
| 55 | Compression Spring |
| 66 | Retainer Pin |
| 77 | Release button |
| 88 | End Retainer Hole |
| 98 | Center Retainer Hole |
| 112 | Slide Members (2) |
| 119 | Lip-Notch |
| 120 | Cap Notch |
| 139 | Shaft |
| 164 | Compartment |
| 181 | Holes (2) |
| 208 | Pin Shaft |

What is claimed is:

1. A convertible luggage handle comprising:

a fixed handle housing, the fixed handle housing comprising a substantially hollow body, a pair of longitudinal sidewalls, an end wall substantially perpendicular to the pair of longitudinal sidewalls, a bottom wall, an open top portion opposite the bottom wall and a pair of extensions on opposite sides of the fixed handle housing, the pair of extensions extending away from the open top portion, each extension having a hole for receiving luggage uprights;

a swivel handle having a first end and a second end, a stepped shaft extending axially from the first end to the second end, a retainer pin inserted through the second end of the swivel handle for retaining the swivel handle to the fixed handle housing, a compression spring located in the shaft, a detent pin extending axially through the shaft and the compression spring, the detent pin has an end cap located at the first end of the swivel handle and a detent portion located at a second end of the swivel handle;

wherein the swivel handle rotates between a first position where the swivel handle is nested in the open top portion of the fixed handle housing and a second position where the swivel handle is perpendicular to the fixed handle housing;

wherein the swivel handle is captivated in the first position by the detent portion which engages in a first detent hole located in the end wall of the fixed handle housing, when the end cap is pulled, the compression spring is compressed and the detent portion is retracted inside the shaft of the swivel handle, the retainer pin extends through the swivel handle and engages a pair of L-shaped slide members extending along the pair of longitudinal sidewalls, the retainer pin slides along the L-shaped slide members as the swivel handle rotates from the first position to the second position, when the end cap is released, the compression spring biases the detent portion to extend outside the shaft of the swivel handle, the swivel handle is then captivated in the second position by the detent portion which engages in a second detent hole located in the bottom wall of the fixed handle housing, the swivel handle can be rotated back to the first position by again pulling the end cap and retracting the detent portion into the shaft of the swivel handle.

2. The convertible luggage handle as claimed in claim 1, further comprising a release button extending from a bottom portion of the fixed handle housing for releasing luggage uprights.

* * * * *